US010006245B1

(12) United States Patent
Marocco

(10) Patent No.: US 10,006,245 B1
(45) Date of Patent: Jun. 26, 2018

(54) TENSION DEVICE

(71) Applicant: Norbert Marocco, Toronto (CA)

(72) Inventor: Norbert Marocco, Toronto (CA)

( * ) Notice: Subject to any disclaimer, the term of this patent is extended or adjusted under 35 U.S.C. 154(b) by 0 days. days.

(21) Appl. No.: 15/379,659

(22) Filed: Dec. 15, 2016

(51) Int. Cl.

| | |
|---|---|
| ***E06B 9/42*** | (2006.01) |
| ***E06B 9/78*** | (2006.01) |
| ***E06B 9/324*** | (2006.01) |
| ***A47H 3/08*** | (2006.01) |

(52) U.S. Cl.
CPC ..... *E06B 9/42* (2013.01); *A47H 3/08* (2013.01); *E06B 9/324* (2013.01); *E06B 9/78* (2013.01); *E06B 2009/785* (2013.01); *Y10T 24/3904* (2015.01)

(58) Field of Classification Search
CPC ... E06B 9/42; E06B 9/324; E06B 9/78; E06B 2009/785; A47H 3/08; Y10T 24/3904
See application file for complete search history.

(56) References Cited

U.S. PATENT DOCUMENTS

| | | | | |
|---|---|---|---|---|
| 3,168,768 | A * | 2/1965 | Bohlinger | A44C 5/209 24/116 A |
| 8,376,022 | B2 * | 2/2013 | Lin | E06B 9/326 160/321 |
| 8,539,645 | B2 | 9/2013 | Marocco | |
| 8,695,174 | B1 * | 4/2014 | Cheng | E06B 9/324 160/187.1 R |
| 9,091,117 | B2 | 7/2015 | Ng | |
| 2012/0279021 | A1 * | 11/2012 | Marocco | A47H 3/08 24/136 K |
| 2015/0197983 | A1 * | 7/2015 | Nicolosi | E06B 9/264 160/107 |
| 2016/0168907 | A1 * | 6/2016 | Byun | E06B 9/326 160/178.2 |

* cited by examiner

*Primary Examiner* — Robert Sandy

(57) ABSTRACT

A spring loaded tensioning device for tensioning a flexible blind control element loop to be secured in position on a building, and having a housing shell;

a hinged door on the housing shell operable between an open position for insertion of the control element and a closed position, a moveable lock in the housing shell, moveable between a locking position in which it clamps onto the element, and a released position in which the lock is free of the control element; and, a spring urging the lock to clamp onto the control element.

12 Claims, 4 Drawing Sheets

TENSION DEVICE

FIELD OF THE INVENTION

The invention relates to a blind accessory for maintaining tension in a blind control element, and for providing an alert whenever the tension on the element is released.

BACKGROUND OF THE INVENTION

Blinds for building openings, eg windows, doors and the like, may be operated either simply down and up, in the case of eg. roller blinds, or in the case of eg. Venetian blinds or vertical shade panels, the shade panels may be rotated open or closed.

The control elements for these blind operations are usually in the form of an endless cord or chain. The control element simply hangs down along one side of the building opening, in an endless loop.

Other forms of blinds and window coverings may also be operated by means of an endless control element hanging in a loop.

In the past this system has been widely used, and experience has mainly been satisfactory. In some cases a pendant weight was located on the loop, to assist in controlling it.

In U.S. Pat. No. 8,539,645 Inventor Mario M. Marocco, there is shown an earlier form of lock for a blind cord loop in which a spring operated lock is used.

However building codes are now requiring that the endless loop type of control element shall be guided and controlled at its lower end. It should always be tensioned. The intent of this code is to prevent any chance that the element, when loose, may possibly create a hazard to children, or handicapped persons, or even pets.

In addition, by guiding and controlling the loop of the element at its lowest point, its operation by anyone becomes somewhat easier. The element is prevented from becoming twisted, or entangled with any other blinds controls, curtains or the like.

A simple pulley, fixed to the building fabric, and holding the loop in tension, would achieve this result, in most cases. However such a pulley may become dislodged or loosened from the building to which it was attached. The guide pulley will then hang loose on the loop of the element, leaving the element uncontrolled, as before.

In other cases the pulley might have been installed incorrectly.

In order to provide a more satisfactory form of cord guide, tension device systems have been developed in which the actual pulley wheel was held by a spring. When the guide was installed correctly, the spring pressure was applied through the pulley wheel to the control element thus holding the endless loop in tension. The control element could then be operated freely.

But if the guide became dislodged, or if the guide was installed incorrectly, the spring was released, the element was held locked by the mechanism in the guide. The blind could not then be operated.

This would alert the home owner to correct the problem, and have the guide reinstalled correctly.

Several such systems have been proposed, and are in use. However these prior systems have suffered from certain problems. In some there were several small loose parts of plastic. The installer had to be trained to assemble these correctly. If any of these parts became loose, they could create a health hazard. They might have been installed incorrectly. They might simply be missing, or lost.

Other systems have required great care in connecting the control element to the pulley, and then setting the spring to the correct tension.

Other systems were costly to manufacture, or might require several different forming dies, at considerable expense.

BRIEF SUMMARY OF THE INVENTION

The present invention seeks to provide such a spring loaded tensioning device for tensioning a blind control element, in which the number of separate parts is reduced to a minimum, and in which installation is greatly simplified, and in which the control element can be attached on the tension device, during manufacture, before the blind has been installed.

The tension device can be preassembled in a factory, and is supplied already attached when the blind is supplied, ready for attachment to the building fabric. No assembly of small parts is required, on site. All that is required is to attach the tension device in the correct location.

The control element can be put in tension by the tension device during installation.

Preferably the tension device will have a hinged door portion which is open in the factory for insertion of the control element, enabling the factory staff to simply attach the tension device to the building first, and then insert the loop of the element into the tension device, and then close the hinged part, securing the element in the tension device.

A lock in the tension device is operated by a spring. The lock can clamp onto the element, when and if the spring pressure on the lock is released.

This will then prevent operation of the control element. The building owner will thus be alerted to the problem, and can correct it, or call for the installer.

The invention achieves this without employing an actual rotatable pulley. Guide surfaces are incorporated in the tension device and the element simply glides freely over those guide surfaces.

The various features of novelty which characterize the invention are pointed out with more particularity in the claims annexed to and forming a part of this disclosure. For a better understanding of the invention, its operating advantages and specific objects attained by its use, reference should be made to the accompanying drawings and descriptive matter in which there are illustrated and described preferred embodiments of the invention.

IN THE DRAWINGS

DESCRIPTION OF A SPECIFIC EMBODIMENT

Figure 1:
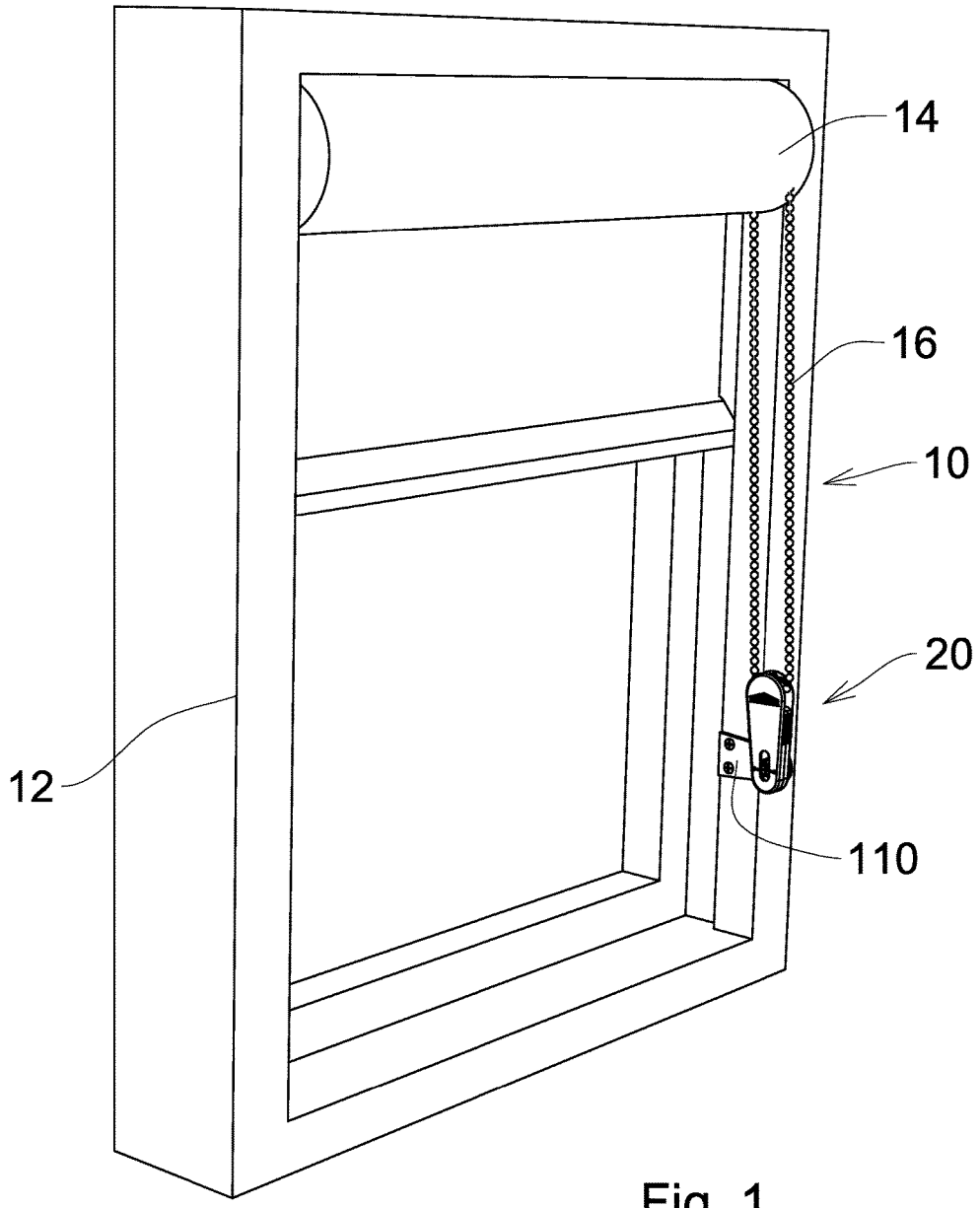
FIG. 1 is a perspective of a simple blind showing a window with a border frame, and a control element, and a tension device on said border frame.
Figure 3:
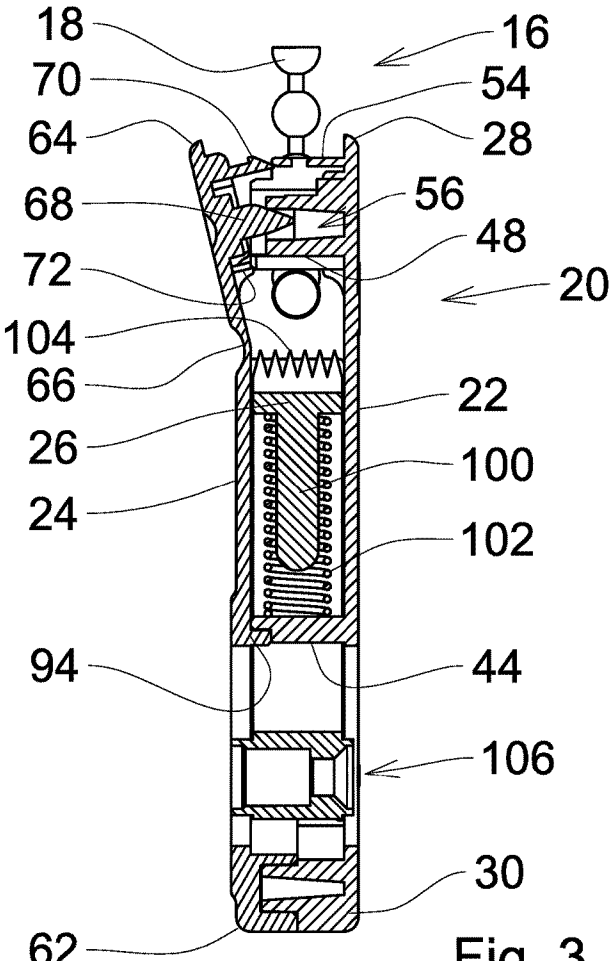
FIG. 3 is a section along line 3-3 of FIG. 2.
Figure 2:
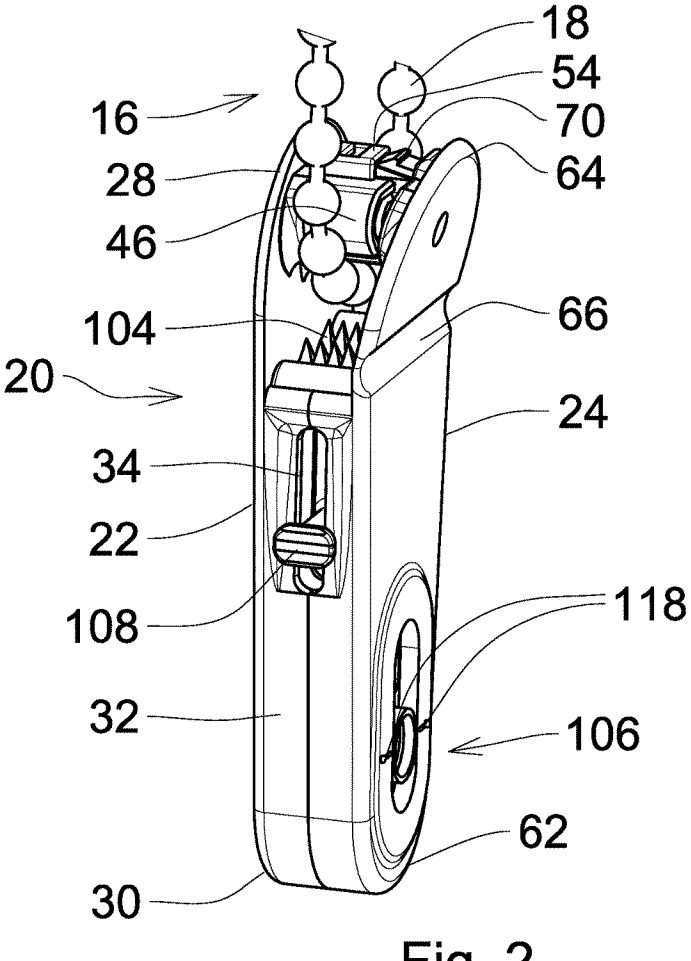
FIG. 2 is a perspective of the tension device of FIG. 1, shown partially opened up.
Figure 4:
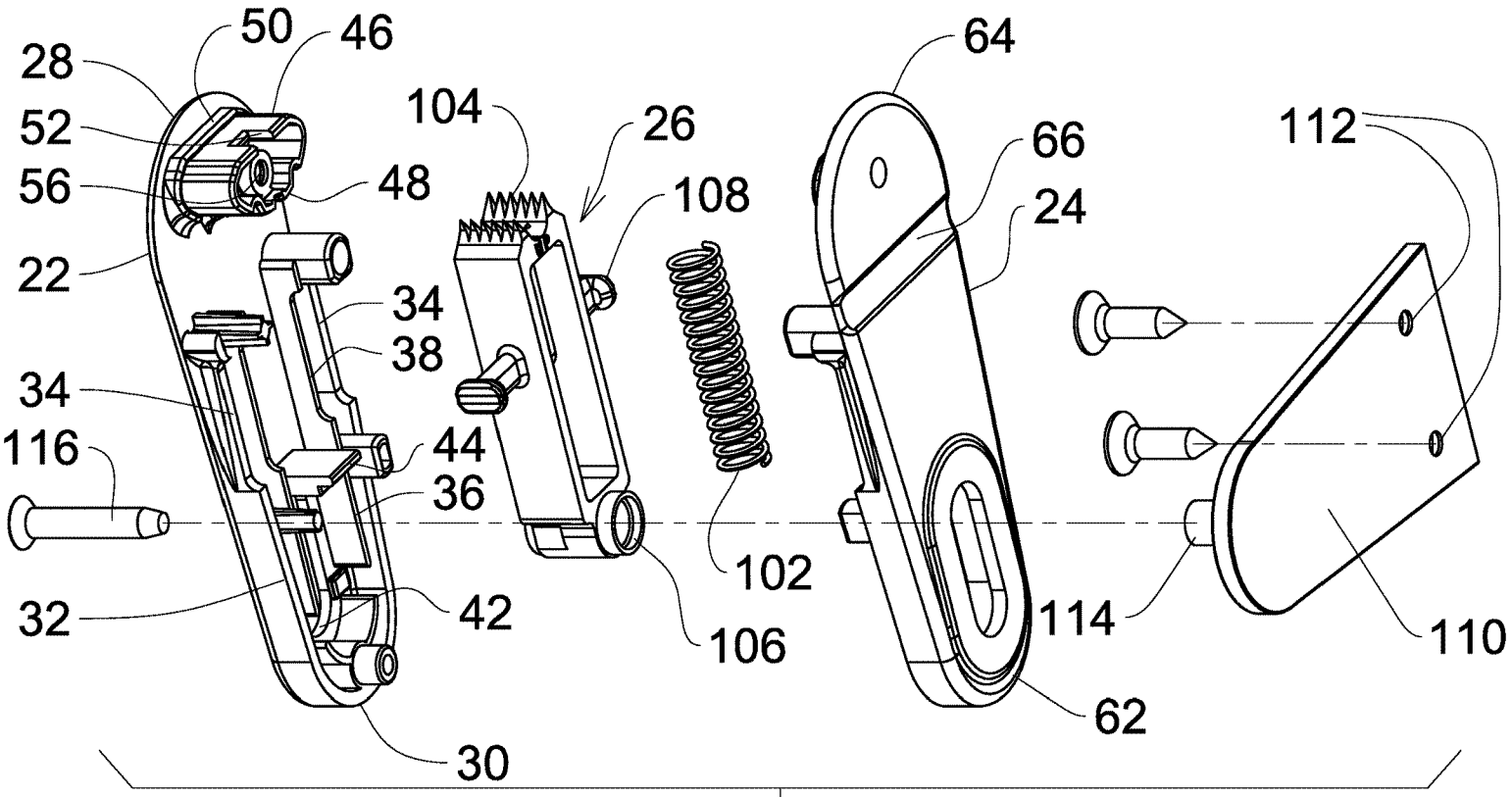
FIG. 4 is an exploded perspective of the tension device.
Figure 6:
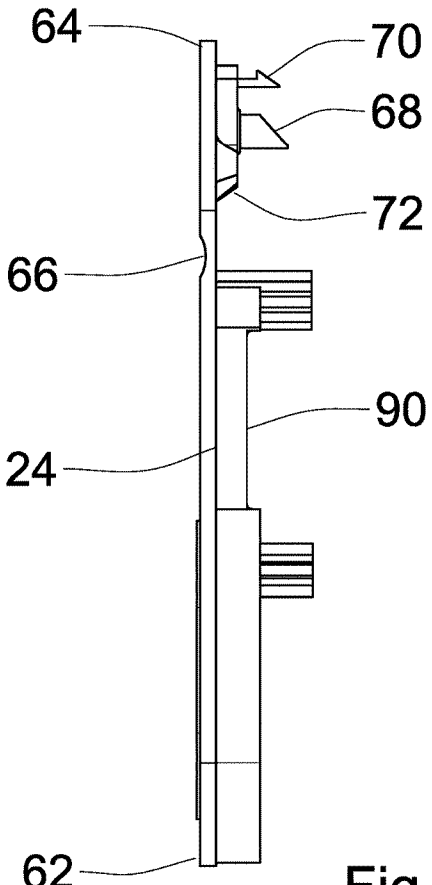
Figure 5:
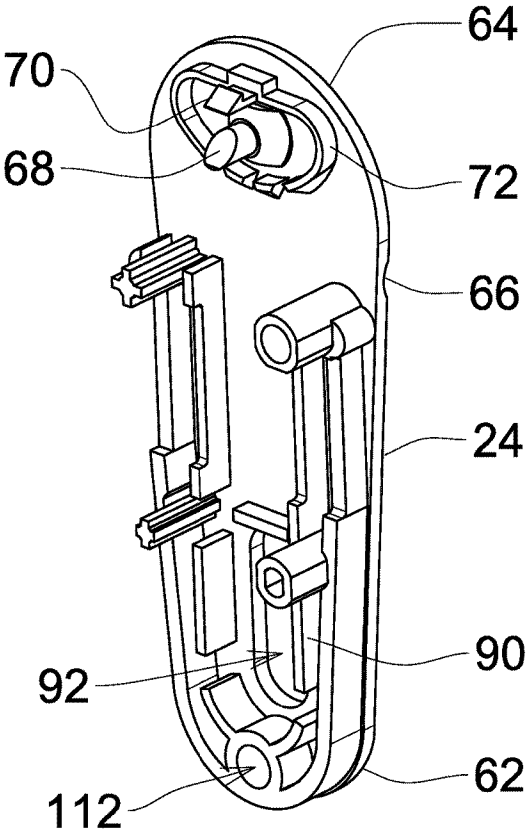
FIG. 5 is a perspective view of one of the components of the tension device; and, FIG. 6 is a side elevation view of the component of FIG. 5.

Referring first to FIG. 1 it will be seen that a simple window, (10) representing a building opening, has a typical border frame (12). A simple roller blind (14) is shown mounted on the frame. The blind, in this example, is a sheet of suitable material wound onto a roller, which may be lowered and raised. The roller is operated, in this case, by a control element (16). The element, in this example is shown as the typical chain type of element, with a series of balls (18) connected by wire or other material, in an endless chain. This element runs around a well known form of sprocket gear drive (not shown) in the mechanism of the blind (14). Such features are very well known in the industry and require no illustration.

The roller blind shown is merely by way of example. Various forms of blind employ the continuous loop type of control element. The invention is applicable to all of them and is not confined solely to the roller blind shown.

The control element, in other cases, may be a continuous length of cord, driving the blind through a different form of drive mechanism (not shown) well known in the art.

The invention is equally applicable to a variety of forms of control element, other than those described.

As explained the endless loop type of control element has been in use for very many years.

Building codes now, however, require that the loop shall be held in tension between the blind, at its upper extremity, and a tension device (20) at its lower extremity.

This is a safety feature, but it also makes the element somewhat easier to operate, by preventing the element from becoming twisted or entangled with itself, or any other blind operating elements, which may be part of a more complex blind system. (not shown), such as, for example, a vertical panel blind system, or a Venetian blind system. The tension device (20) is illustrated in more detail in FIGS. 2, 3, 4, 5, and 6. The tension device has a first shell (22), a second shell (24), and a captive slide lock (26). The first shell (22) is formed of synthetic plastic and has upper and lower ends (28) and (30). Each end is formed with a generally semi-circular profile, in this case. Outer edge walls (32) extends perpendicularly from the first shell (22) and extend from the lower end (30) upwardly along, but terminate below the upper end (28)

The outer edge walls (32) define reduced height portions (34) on each side.

First shell slide walls (36) also extend normal to first shell (22), and are spaced inwardly from outer edge walls (32). The first shell slide walls (36) also define reduced height portions (38), for reasons to be described. Lower end wall portions extend around the lower ends of first shell slide walls (36).

The upper extremities of first shell slide walls (36) are spaced apart and define a free space therebetween. An elongated generally oval shaped opening (42) is formed in first shell (22) between the first shell slide walls (36), and located towards the lower end (30) of first shell (22).

A spring support ledge (44) of generally rectangular shape extends normal from first shell (22), extending transversely between first shell slide walls (36), and located mid way between the upper and lower extremities of first shell slide walls (36) upwardly from the upper end of opening (42).

Located at the upper end of first shell (22), spaced from the upper ends of outer walls (32) and first shell slide walls (36), is a fixed hub (46) which defines glide surfaces (48) around which the control element (16) can slide freely.

This serves in effect as a pulley, although it does not rotate.

Where the hub meets the first shell (22) there is a collar ridge (50) formed, to guide the element (16).

A notch (52) is defined by hub (46) with a lock wall (54) formed on first shell (22).

Enclosed within but separate from hub (46), there is a pin socket (56).

The second shell (24) (FIGS. 5 and 6) is formed of synthetic plastic material and has lower and upper ends, the lower end being referenced as (62), both being of generally semi-circular shape, with an edge wall matching the shape of the first shell outer edge wall.

Adjacent the upper end of second shell (24) there is a moveable door portion (64) and a flexible self-hinge groove (66). The self hinge is merely one method of making the door portion (64) moveable. The moveable door portion (64) can thus be flexed outwardly and inwardly to enable the manufacturing staff persons to install the element (16) (FIG. 2), in the factory.

A locking pin (68) extends from this upper portion of second shell (24) and mates with pin socket (56) of first shell (22).

A register hook (70) extends from second shell (24) above locking pin (68), and mates with lock wall (54) of first shell (22).

A guide collar (72) is formed on this upper portion of second shell (24), which complements and abuts against hub (46) of first shell (22).

Register sleeves and pins described below on the first and second shells cooperate together to hold the two shells secured together, in registration.

A pair of parallel elongated second shell inner slide walls (90) are formed on second shell (24).

An elongated generally oval shaped opening (92) is formed in second shell (24), which registers with opening (42) in first shell (22).

A shelf wall (94) is formed within the space defined within second shell slide walls (90), adjacent the upper end of opening (92). Shelf wall (94) is normal to second shell (24) and co-operates with ledge (44) on first shell (22), to provide support for the free end of ledge (44).

The rectangular hollow captive slide lock (26) is located within first shell and second shell slide walls (38) and (90).

In the hollow interior of captive slide lock (26) there is a spring guide rod (100) extending downwardly from the upper end of slide lock (26), which receives and guides a spring (102). One end of spring (102) abuts against the upper inner end of slide lock (26). The opposite end of spring (102) abuts against ledge (44) of first shell (22).

The free end of ledge (44) overlaps and inter fits with the shelf wall (94) of second shell (24). This provides secure support for the ledge (44) enabling it to resist the pressure of spring (102).

At the upper end of slide lock (26) there are two upstanding rows of teeth (104).

The teeth are located so as to engage with element (16), where it passes over the hub (46) and thus prevents the element from passing around hub (46).

At the opposite end of slide lock (26) there is a screw housing sleeve (106). This is open at both ends and permits a screw fastening to be passed completely through it.

A pair of finger buttons (108) extend out from slide lock (26) on opposite sides. The buttons pass out of the two shells through the reduced height portions of the outer edge walls and slide walls.

In order to secure the tension device in position on for example a window frame, a mounting plate (110) is provided. Plate (110) has two fastening holes (112) enabling screws (not shown) to secure the plate to the window frame.

Plate (110) has a rod (114) formed normal thereto. Rod (114) preferably has a screw receiving bore (not shown) for receiving a screw (116) passed through screw housing sleeve (106) of slide lock (26). Visible indicia (118) on the housing shell assist in positioning the slide lock in the desired position, during installation.

To hold the two shell parts together, in registration with one another, register pins (120) and register sleeves (122) are provided.

In operation the hinge (66) of the second shell (24) has been flexed and the moveable door portion is open in the factory. The element is installed and the moveable door portion is then closed.

After delivery to the customer site, the service person then installs the blind in the window frame, by whatever method is provided with the blind (not shown).

The service person then grasps the buttons (108) of the lock (26) downwardly, compressing spring (102). This opens up the space around the hub (46). He then moves the tension device down to the bottom of the control element loop. and can release the buttons.

The lock (26) will then react from the pressure of spring (102). and the teeth will grip the element against the hub (46).

Now the serviceman has to locate the plate (110) at the correct distance from the element (16), and the blind.

To do this he can again grip the buttons (108) and move the lock (26) against the spring (102) to release the element. By using the indicia (118) on the tension device as his guide he can position the lock (26) with the desired degree of tension.

He places the rod (114) of the plate (110) through the sleeve (106), and can then mark the desired location of the plate on the window frame.

He secures the plate with screws through holes (112), to the window frame.

Now he simply grasps the buttons (108) once more and draws the tension device down until he can slide the sleeve (106) of slide lock (26) onto the rod (114). He then puts the final screw (116), through sleeve (106) into the bore of rod (114). The element can now run freely around hub (46). In this condition the element is held in tension in a controlled loop. The spring and the hub (46) apply tension to the element. Operation of the blind is made easier. The hazard of a loose loop of element is eliminated. If for any reason the tension device comes loose from its position of the window frame, the slide lock (26) will be released, and moves under the pressure of the spring The teeth will then grip the element against hub (46).

The blind cannot then be operated, or if operated it is with much inconvenience. The home owner will at once be alerted to this malfunction, and can reinstall the tension device, or call the service man.

The foregoing is a description of a preferred embodiment of the invention which is given here by way of example only. The invention is not limited thereby.

What is claimed is:

1. A spring loaded tensioning device for tensioning a flexible blind control element loop to be secured in position on a building, and comprising;

a housing shell;

a moveable door portion on said housing shell, said door portion being operable between an open position for insertion of the flexible control element loop into said housing shell and a closed position for securing the flexible control element loop in said housing shell;

a moveable lock in the housing shell, moveable between a locking position in which it clamps onto said flexible blind control element loop, and a released position in which said lock is free of said flexible blind control element loop; and, a spring urging said lock to clamp onto the flexible blind control element loop.

2. The spring loaded tensioning device for tensioning a flexible blind control element loop as claimed in claim 1 and including;

a first shell part and a second shell part, forming said housing shell;

a hinged portion on one of said first and second shell parts, forming said moveable door portion, said hinged portion being operable between an open position for insertion of the flexible blind control element loop and a closed position for securing the flexible blind control element loop in the housing shell.

3. The spring loaded tensioning device for tensioning a flexible blind control element loop as claimed in claim 2 including guide surfaces on one of said shell parts around which said flexible blind control element loop can move.

4. The spring loaded tensioning device for tensioning a flexible blind control element loop as claimed in claim 3 wherein said lock comprises a generally rectangular slidable lock member, defining a hollow interior, and a spring control rod forming part of said lock member, located within said hollow interior, and wherein said spring is mounted on said spring control rod.

5. The spring loaded tensioning device for tensioning a flexible blind control element loop as claimed in claim 4 including a hub formed on one said shell part defining said guide surfaces for said flexible blind control element loop, and a complementary guide flange on the other said shell part, mating with said hub.

6. The spring loaded tensioning device for tensioning a flexible blind control element loop as claimed in claim 5 including elongated generally oval shaped shell openings in each said shell part, said elongated generally oval openings registering with one another, and a screw sleeve formed on said slidable lock member open at both ends, and registering with said elongated generally oval shell openings.

7. The spring loaded tensioning device for tensioning a flexible blind control element loop as claimed in claim 6, and including finger buttons formed integrally with said slidable lock member, and side openings in at least one of said shell parts, said finger buttons extending through said side openings and accessible on the exterior of said housing shell for operation of said slidable lock member.

8. The spring loaded tensioning device for tensioning a flexible blind control element loop as claimed in claim 7 including a ledge on one of said shell parts, extending normal thereto for supporting one end of said spring, and an abutment on the other of said shell parts located to interfit with and support said ledge.

9. The spring loaded tensioning device for tensioning a flexible blind control element loop as claimed in claim 8, and including teeth on said slidable lock member located to engage said flexible blind control element loop, when said lock member is in its said locking position.

10. The spring loaded tensioning device for tensioning a flexible blind control element loop as claimed in claim 9 including a mounting plate attachable to the window frame, and a stub on the plate connectable with said tension device.

11. The spring loaded tensioning device for tensioning a flexible blind control element loop as claimed in claim 10 including register pins and sleeves for receiving said pins, on said shell parts.

12. The spring loaded tensioning device for tensioning a flexible blind control element loop as claimed in claim 11 including openings in said housing shell for receiving said flexible blind control element loop therethrough.

* * * * *